US006213858B1

(12) United States Patent
Lombardo

(10) Patent No.: US 6,213,858 B1
(45) Date of Patent: Apr. 10, 2001

(54) BELTS FOR POLISHING SEMICONDUCTORS

(75) Inventor: Brian Lombardo, Amherst, NH (US)

(73) Assignee: Scapa Group PLC, Blackburn (GB)

( * ) Notice: Subject to any disclaimer, the term of this patent is extended or adjusted under 35 U.S.C. 154(b) by 0 days.

(21) Appl. No.: 09/427,108

(22) Filed: Oct. 26, 1999

Related U.S. Application Data

(60) Provisional application No. 60/105,606, filed on Oct. 26, 1998.

(51) Int. Cl.[7] ..... B24D 11/00

(52) U.S. Cl. ..... 451/526; 451/527; 451/529; 451/533; 451/539

(58) Field of Search ..... 451/526, 527, 451/529, 541, 178, 533, 539

(56) References Cited

U.S. PATENT DOCUMENTS

| | | | | |
|---|---|---|---|---|
| 1,994,283 | | 3/1935 | Martin | 51/278 |
| 4,337,598 | * | 7/1982 | Barth et al. . | |
| 4,715,150 | * | 12/1987 | Takeuchi et al. . | |
| 5,692,947 | | 12/1997 | Talieh et al. | 451/41 |
| 5,733,178 | * | 3/1998 | Ohishi . | |
| 5,769,691 | * | 6/1998 | Fruitman . | |
| 5,876,269 | * | 3/1999 | Torii . | |
| 6,030,279 | * | 2/2000 | Russell . | |
| 6,042,462 | * | 3/2000 | Baratti . | |

FOREIGN PATENT DOCUMENTS

| | | |
|---|---|---|
| WO93/12911 | 7/1993 | (WO) . |
| WO98/35785 | 8/1998 | (WO) . |

* cited by examiner

*Primary Examiner*—Timothy V. Eley
*Assistant Examiner*—Willie Berry Jr.
(74) *Attorney, Agent, or Firm*—Lyon & Lyon LLP

(57) ABSTRACT

A seamless, composite belt that is designed to maintain a substantially flat surface in the span between two rollers. The belts typically have one or more polymer layers, including the polishing layer, and one or more supporting woven or non-woven layers. The belts have the necessary balance between down-cupping and up-cupping forces achieved by: 1) varying the relative thickness of the different polymer and supporting layers in the belt, 2) varying the relative hardness or rigidity of the different layers in the belt, 3) varying the temperatures at which the different layers are formed, 4) varying the compositions of supporting layers, and 5) pre-stressing one or more of the composite layers. The belts are particularly useful in chemical mechanical polishing of semiconductor wafers.

20 Claims, No Drawings

BELTS FOR POLISHING SEMICONDUCTORS

This application claims the benefit of U.S. Provisional Application No. 60/105,606, filed Oct. 26, 1998.

BACKGROUND OF THE INVENTION

The purpose of this invention is to produce seamless, composite belts for improved polishing of semiconductor wafers as a result of the belts lying flat, without cupping up or down, while in contact with a semiconductor wafer.

Chemical mechanical polishing (CMP) of semiconductor wafers is a relatively new technology used in the manufacture of integrated circuits. Conventional CMP technology involves holding a wafer face down in contact with a flat polishing pad mounted on a rotating turntable. This arrangement derived from traditional glass polishing technology. More recently a new type of CMP polishing tool has been invented by Ontrak Systems, later acquired by Lam Research. The new tool, as described in U.S. Pat. No. 5,692,947, uses a linear polishing member comprising a conventional, flat polishing pad adhered to a supporting endless metal belt. Currently there are no one-piece belts available either for use in polishing semiconductor wafers or for use on Lam's tool.

A division of Scapa Group has been developing a seamless, composite belt for use on Lam's proprietary polishing tool. There are many difficulties and constraints involved with developing such a belt that integrally combines sufficient strength and a precision polishing surface and that can be manufactured efficiently and consistently. One unexpected problem in particular was that the prototype belts would not maintain a flat surface, i. e., the edges of the belt would curl up or down in the span between the mounting rollers, which resulted in poor polishing performance because of uneven contact with the surface of the semiconductor wafer. The present invention overcomes this critical problem.

SUMMARY OF THE INVENTION

The present invention comprises a seamless, composite belt that is designed, constructed, or manufactured to maintain a substantially flat surface in the span between two rollers. The belts of the present invention typically have one or more polymer layers, including the polishing layer, and one or more supporting woven or non-woven layers. The present invention is accomplished by achieving the necessary balance between down-cupping and up-cupping forces using one or more of the following approaches: 1) varying the relative thickness of the different polymer and supporting layers in the belt, 2) varying the relative hardness or rigidity of the different layers in the belt, 3) varying the temperatures at which the different layers are formed, 4) varying the compositions of supporting layers, and 5) prestressing one or more of the composite layers.

Belts of the present invention are particularly useful in chemical mechanical polishing of semiconductor wafers, where it is critical to maintain even contact with the entire surface of the flat wafer. In addition, belts of the present invention would be useful in other applications, including other polishing applications, printing applications, and material handling applications, for example, where uniform contact between the belt and the workpiece is necessary.

BRIEF DESCRIPTION OF THE INVENTION

The seamless, composite belts of the present invention are typically produced by casting, compression molding, or injection molding a polymer layer onto a supporting layer. The manufacturing process typically involves elevated temperatures in order to melt and flow thermoplastic materials or to combine and cure thermoset materials. However the polymeric materials may be cured at any suitable temperature or sequence of different temperatures and times as desired. The polymeric layer can be any suitable material of combination of materials. It can be solid or porous, and it may contain any types or combinations of fillers and active or inert ingredients. Typically a substantially cylindrical mold is used to produce belts with symmetrical properties and without splices or seams. The mold can be static, or it can be spinning, as in centrifugal casting. Another option for forming belts with symmetrical properties would include forming the belts on a rotating cylindrical core or roller. It is possible that the belts could be manufactured by a continuous extrusion of a polymer layer onto a tubular support material that is then sliced into belts of a desired width.

A composite belt of at least two different layers typically is needed to provide both the precision polishing surface and the necessary mechanical strength of the belt. The polishing layer can be smooth or textured and can have any suitable pattern of grooves, depressions, or raised features, that have been molded in or achieved by machining or other secondary operations. The supporting layers may be any type of woven or non-woven fabric, made of natural or synthetic, organic or inorganic materials.

However, the composite structure can lead to uneven internal stresses when the belt is at rest and when it is mounted on rollers under tension, which often result in the edges of the belt cupping up or down in the span between the mounting rollers. Often the uneven internal stresses are caused by the use of materials with different thermal or molecular shrinkage rates or different tensile, shear, and compressive properties. Given this understanding of the potential causes of belt cupping, it would seem logical to look for a way to totally eliminate the uneven internal stresses either by matching properties of different materials or by finding a single material that both polishes and provides mechanical strength. However, a single component belt that is seamless and that has been formed in a substantially cylindrical shape, for example a solid rubber or urethane belt, will not lie perfectly flat in the span between the mounting rollers, and in fact the edges will cup downward. A surprising feature of this invention is that the belts must have a composite structure in order for the seamless polishing belts to provide the flat surface in the span where the wafers are contacted.

The composite structure is necessary in order to provide the right balance of up-cupping and down-cupping forces in the belt when spanned between mounting rollers. Balancing the up-cupping and the down-cupping forces can be achieved by using one or a combination of the following approaches: 1) varying the relative thickness of the different polymer and supporting layers in the belt, 2) varying the relative hardness or rigidity of the different layers in the belt, 3) varying the temperatures at which the different layers are formed, 4) varying the compositions of supporting layers, and 5) prestressing one or more of the composite layers. In addition it is possible to create a suitable balance between up-cupping and down-cupping by forming a belt with alternating sections around the length of the belt that have opposite tendencies to cup. The alternating up-cupping and down-cupping sections tend to cancel each other out to force the belt to lie substantially flat throughout the span between the mounting rollers.

Examples of belt structures that have the desired balance of up-cupping and down-cupping in order to lie flat include 1) A three-layer belt where a woven fabric is coated on both sides by hot cast polyurethane and where the top layer of urethane is thicker than the bottom layer.
2) A two-layer belt where a loosely woven, mesh fabric is coated on the outside or top by hot cast polyurethane.
3) A two-layer belt where a hot cast polyurethane layer is formed with wound reinforcing cord.
4) A two-layer belt where the hot cast polyurethane layer is formed over a prestressed fabric being held under tension during the molding process.
5) A two-layer belt where a fabric layer is coated with a polyurethane layer that is allowed to solidify at room temperature before completing the cure cycle at a higher temperature.
6) A three-layer belt where the top and bottom layers are the same thickness but the top layer is made of a more rigid material than the bottom layer.
7) A three-layer belt where the top layer is a uniform thickness but the bottom layer varies in thickness sinusoidally so as to create alternating sections with slight up-cupping and slight down-cupping tendencies.
8) A three-layer belt where the top layer is a foam and the bottom layer is a solid material.

I claim:

1. A seamless, composite belt which will maintain a substantially flat surface in a span between two spaced apart mounting surfaces; the belt comprising one or more polymer layers, and one or more supporting woven, or non-woven layers, and further comprising structural properties to achieve a balance between down-cupping and up-cupping forces exerted on the belt in the span between the mounting surfaces.

2. The belt of claim 1 having a plurality of polymer layers of different thickness.

3. The belt of claim 1 having a plurality of polymer layers of different hardness or rigidity.

4. The belt of claim 1 having a plurality of polymer layers formed at different temperatures.

5. The belt of claim 1 having a plurality of polymer layers of different compositions.

6. The belt of claim 1 wherein one or more of the polymer and supporting layers are prestressed.

7. The belt of claim 1 wherein the belt has alternating sections around the length of the belt, said sections having opposite tendencies to cup.

8. The belt of claim 1 wherein the belt is in substantially cylindrical shape.

9. The belt of claim 1 wherein the belt is a three-layer belt having a woven fabric layer coated on both sides by hot cast polyurethane to form a top and a bottom polymer layer and wherein the top layer of urethane is thicker than the bottom layer.

10. The belt of claim 1 wherein the belt is a two-layer belt having a loosely woven, mesh fabric layer coated with a hot cast polyurethane layer.

11. The belt of claim 1 wherein the belt is a two-layer belt having a hot cast polyurethane layer formed with wound reinforcing cord.

12. The belt of claim 1 wherein the belt is a two-layer belt having a hot cast polyurethane layer formed over a prestressed fabric layer held under tension during a molding process.

13. The belt of claim 1 wherein the belt is a two-layer belt having a fabric layer coated with a polyurethane layer that is allowed to solidify at room temperature before completing a cure cycle at a higher temperature.

14. The belt of claim 1 wherein the belt is a three-layer belt having top and bottom polymer layers of the same thickness on either side of the supporting layer, and having the top polymer layer made of a more rigid material than the bottom polymer layer.

15. The belt of claim 1 wherein the belt is a three-layer belt having a top polymer layer of a uniform thickness above the supporting layer and a bottom polymer layer below the supporting layer which varies in thickness sinusoidally so as to create alternating sections with slight up-cupping and slight down-cupping tendencies.

16. The belt of claim 1 wherein the belt is a three-layer belt having a supporting layer sandwiched between top and bottom polymer layers, and wherein the top polymer layer is formed from a polymer foam and the bottom polymer layer is formed from a solid polymer.

17. The belt of claim 1, wherein said structural properties include one or a combination of the following properties:

(a) varying the relative thickness of the different polymer and supporting layers in the belt;
(b) varying the relative hardness or rigidity of the different layers in the belt;
(c) varying the temperatures at which the different layers are formed;
(d) varying the compositions of supporting layers; and
(e) prestressing one or more of the composite layers.

18. The belt of claim 1, wherein one of the polymer layers is a polishing layer.

19. The belt of claim 1, wherein the two spaced apart mounting surfaces are rollers.

20. The belt of claim 19, wherein the rollers are part of a chemical mechanical polishing tool for the polishing of silicon or semiconductor wafers.

* * * * *